US011334022B2

(12) United States Patent
Ikegami et al.

(10) Patent No.: US 11,334,022 B2
(45) Date of Patent: *May 17, 2022

(54) IMAGE FORMING APPARATUS INCLUDING COMMON DRIVE SOURCE FOR DRIVING DEVELOPING ROLLER AND CAM THAT MOVES DEVELOPING ROLLER TOWARD AND AWAY FROM PHOTOSENSITIVE DRUM

(71) Applicant: BROTHER KOGYO KABUSHIKI KAISHA, Nagoya (JP)

(72) Inventors: Yusuke Ikegami, Nagoya (JP); Masahito Saeki, Nagoya (JP); Shintaro Sakaguchi, Nagoya (JP); Toshiyuki Sano, Iwakura (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

This patent is subject to a terminal disclaimer.

(21) Appl. No.: 17/326,626

(22) Filed: May 21, 2021

(65) Prior Publication Data

US 2021/0278798 A1 Sep. 9, 2021

Related U.S. Application Data

(63) Continuation of application No. 16/924,427, filed on Jul. 9, 2020, now Pat. No. 11,079,714.

(30) Foreign Application Priority Data

Jul. 10, 2019 (JP) ..... JP2019-128364

(51) Int. Cl.
*G03G 21/16* (2006.01)

(52) U.S. Cl.
CPC ..... *G03G 21/1647* (2013.01); *G03G 21/1676* (2013.01); *G03G 2221/163* (2013.01)

(58) Field of Classification Search
CPC ..... G03G 15/0173; G03G 21/1647; G03G 21/1676; G03G 21/1857; G03G 2221/163; G03G 2221/1654; G03G 2221/1657
See application file for complete search history.

(56) References Cited

U.S. PATENT DOCUMENTS 11,079,714 B2 * 8/2021 Ikegami ..... G03G 21/1647
2012/0251170 A1 10/2012 Hashimoto
(Continued)

FOREIGN PATENT DOCUMENTS

JP 2012-128017 A 7/2012

*Primary Examiner* — Sophia S Chen
(74) *Attorney, Agent, or Firm* — Scully, Scott, Murphy & Presser, P.C.

(57) ABSTRACT

An image forming apparatus includes a photosensitive drum, a developing roller, a cam, a developing motor, a first transmission mechanism, and a second transmission mechanism. The cam moves the developing roller between a contacting position where the developing roller is in contact with the photosensitive drum and a separated position where the developing roller is separated from the photosensitive drum. The developing motor drives both the developing roller and the cam, and is rotatable in a normal rotating direction and a reverse rotating direction. The first transmission mechanism engages power transmission from the developing motor to the developing roller when the developing motor rotates in the normal rotating direction, and disengages the power transmission when the developing motor rotates in the reverse rotating direction. The second transmission mechanism can engage power transmission from the developing motor to the cam, irrespective of the rotating direction of the developing motor.

18 Claims, 7 Drawing Sheets

(56) References Cited

U.S. PATENT DOCUMENTS

| | | | | |
|---|---|---|---|---|
| 2018/0136604 | A1* | 5/2018 | Lee | G03G 21/1857 |
| 2020/0301358 | A1 | 9/2020 | Haruta et al. | |
| 2020/0310281 | A1 | 10/2020 | Haruta et al. | |
| 2020/0387081 | A1 | 12/2020 | Sakaguchi et al. | |

* cited by examiner

FIG. 3

| | DEVELOPING MOTOR | |
|---|---|---|
| | NORMAL ROTATION | REVERSE ROTATION |
| ELECTROMAGNETIC CLUTCH ON | CAM: NORMAL ROTATION<br>DEVELOPING ROLLER: NORMAL ROTATION | CAM: REVERSE ROTATION<br>DEVELOPING ROLLER: STOP |
| ELECTROMAGNETIC CLUTCH OFF | CAM: STOP<br>DEVELOPING ROLLER: NORMAL ROTATION | CAM: STOP<br>DEVELOPING ROLLER: STOP |

IMAGE FORMING APPARATUS INCLUDING COMMON DRIVE SOURCE FOR DRIVING DEVELOPING ROLLER AND CAM THAT MOVES DEVELOPING ROLLER TOWARD AND AWAY FROM PHOTOSENSITIVE DRUM

CROSS REFERENCE TO RELATED APPLICATION

This application is a continuation application of U.S. patent application Ser. No. 16/924,427 filed Jul. 9, 2020 and claims priority from Japanese Patent Application No. 2019-128364 filed Jul. 10, 2019. The entire content of the priority application is incorporated herein by reference.

TECHNICAL FIELD

The present disclosure relates to an image forming apparatus in which a developing roller can be brought into contact with and separated from a photosensitive drum.

BACKGROUND

In a conventional image forming apparatus, a dedicated motor is generally provided for each component to be driven. For example, Japanese Patent Application Publication No. 2012-128017 discloses an image forming apparatus including a photosensitive drum and a developing roller. The photosensitive drum is driven by a drive motor, and a cam for performing switching between a contact state in which the developing roller is in contact with the photosensitive drum and a separated state in which the developing roller is separated from the photosensitive drum is driven by a step motor different from the drive motor.

SUMMARY

In order to attain downsizing and energy saving in image forming apparatuses, it is desirable to reduce the number of components requiring electric power such as motors. For example, in an image forming apparatus where a developing roller can be brought into contact with and separated from a photosensitive drum, it is conceivable to reduce the number of motors by employing a common motor driving both the developing roller and a cam for bringing the developing roller into contact with the photosensitive drum and separating the developing roller from the photosensitive drum.

However, provided that the developing roller and the cam are drivingly connected to the common motor, it is difficult to selectively perform various combinations of operations of the developing roller and the cam. For example, it is difficult to selectively perform the following two operations: an operation of bringing the developing roller into contact with the photosensitive drum and separating the developing roller therefrom by rotating the cam while rotating the developing roller, and an operation of bringing the developing roller into contact with the photosensitive drum and separating the developing roller therefrom by rotating only the cam in a state where the developing roller is stopped.

In view of foregoing, it is an object of the disclosure to provide an image forming apparatus including a common motor for driving both a developing roller and a cam used for bringing the developing roller into contact with a photosensitive drum and separating the developing roller therefrom, and capable of selectively perform at least the following two operations: an operation of bringing the developing roller into contact with the photosensitive drum and separating the developing roller therefrom by rotating the cam while rotating the developing roller, and an operation of bringing the developing roller into contact with the photosensitive drum and separating the developing roller therefrom by rotating only the cam in a state where the developing roller is stopped.

In order to attain the above and other objects, according to one aspect, the present disclosure provide an image forming apparatus including a photosensitive drum, a developing roller, a cam, a developing motor, a first transmission mechanism, and a second transmission mechanism. The cam is for moving the developing roller between a contacting position where the developing roller is in contact with the photosensitive drum and a separated position where the developing roller is separated from the photosensitive drum. The developing motor is for driving both the developing roller and the cam. The developing motor is rotatable in a normal rotating direction and a reverse rotating direction. The first transmission mechanism is configured to: engage power transmission from the developing motor to the developing roller when the developing motor rotates in the normal rotating direction; and disengage the power transmission from the developing motor to the developing roller when the developing motor rotates in the reverse rotating direction. The second transmission mechanism is capable of engaging power transmission from the developing motor to the cam, irrespective of whether the developing motor rotates in the normal rotating direction or in the reverse rotating direction.

According to another aspect, the present disclosure provides an image forming apparatus including a photosensitive drum, a developing roller, a cam, a developing motor, a one-way clutch, and an electromagnetic clutch. The cam is for moving the developing roller between a contacting position where the developing roller is in contact with the photosensitive drum and a separated position where the developing roller is separated from the photosensitive drum. The developing motor is for driving both the developing roller and the cam. The developing motor is rotatable in a normal rotating direction and a reverse rotating direction. The one-way clutch is configured to: engage power transmission from the developing motor to the developing roller when the developing motor rotates in the normal rotating direction; and disengage the power transmission from the developing motor to the developing roller when the developing motor rotates in the reverse rotating direction. The electromagnetic clutch is configured to engage and disengage power transmission from the developing motor to the cam.

BRIEF DESCRIPTION OF THE DRAWINGS

The particular features and advantages of the embodiment(s) as well as other objects will become apparent from the following description taken in connection with the accompanying drawings, in which:

FIG. 3 is a table illustrating operations of the cam and the developing roller in accordance with operating states of a developing motor and an electromagnetic clutch in the image forming apparatus according to the embodiment;

DETAILED DESCRIPTION

Figure 1:
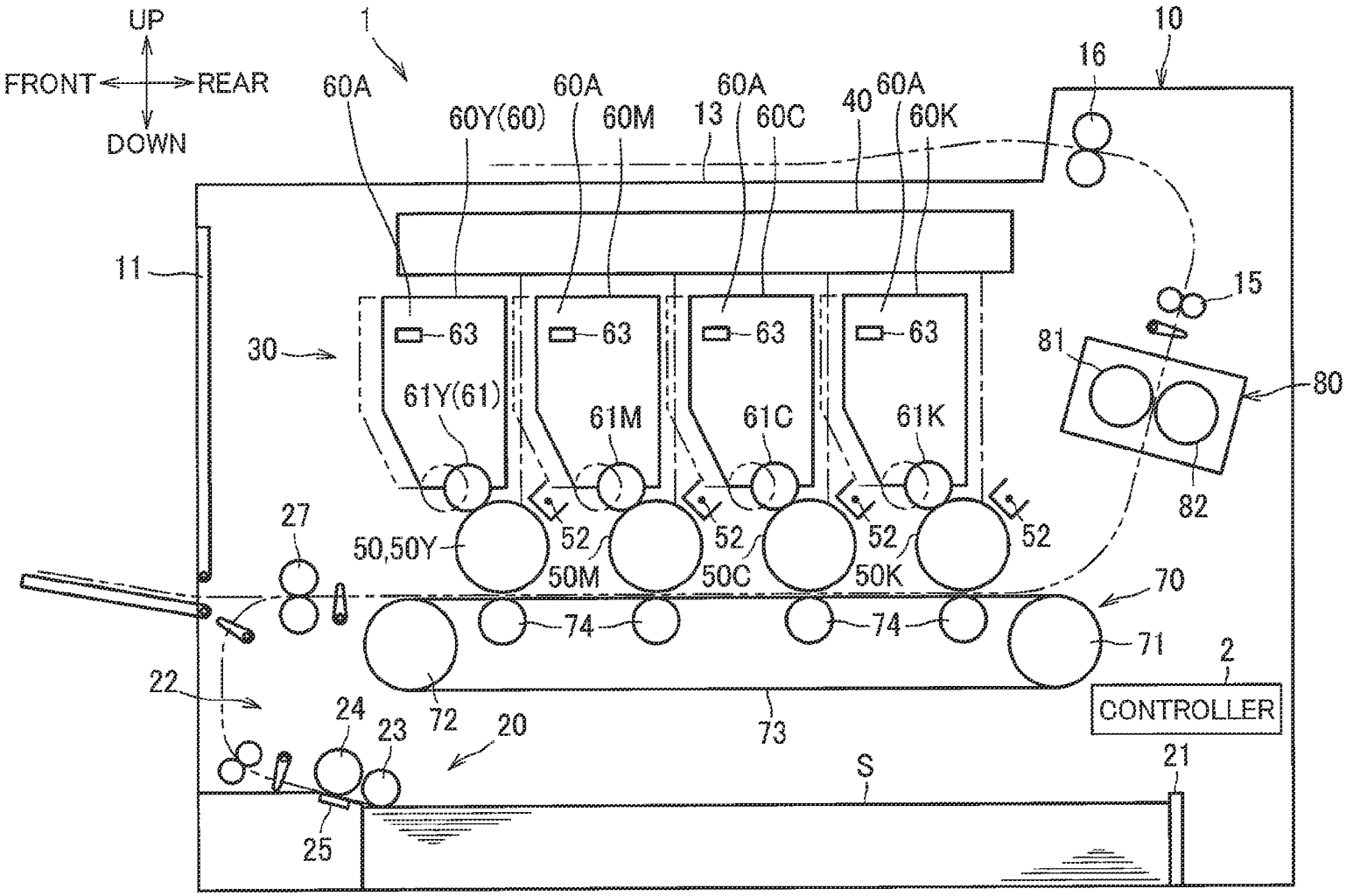
FIG. 1 is a schematic view of an image forming apparatus according to one embodiment.

An image forming apparatus 1 according to one embodiment will be described with reference to the accompanying drawings. As illustrated in FIG. 1, the image forming apparatus 1 is a color printer, for example. The image forming apparatus 1 includes a housing 10, a sheet supply unit 20, an image forming unit 30, and a controller 2 those provided inside the housing 10. The housing 10 is formed with a front opening, and includes a front cover 11 for opening and closing the front opening. Further, the housing 10 has an upper surface functioning as a discharge tray 13.

The sheet supply unit 20 is positioned at a lower internal portion of the housing 10, and includes a sheet tray 21 on which sheets S are mounted, and a sheet supply mechanism 22 configured to supply the sheets S from the sheet tray 21 toward the image forming unit 30. The sheet tray 21 is configured to be detached from the housing 10 by being pulled out to the left in FIG. 1.

The sheet supply mechanism 22 is positioned at a front internal portion of the housing 10, and includes a sheet supply roller 23, a separation roller 24, a separation pad 25, and a registration roller 27. Incidentally, throughout the specification, the left side, the right side, the upper side, and the lower side in FIG. 1 will be referred to as the front side, the rear side, the upper side, and the lower side of the image forming apparatus 1, respectively. Further, the near side and the far side in FIG. 1 will be referred to as the right side and the left side of the image forming apparatus 1, respectively. The sheet S is a medium on which an image can be formed by the image forming apparatus 1. The examples of the sheet S include an envelope, a postal card, plain paper, thin paper, thick paper, glossy paper, a resin sheet, and a seal and the like.

In the sheet supply unit 20, the sheets S accommodated in the sheet tray 21 are fed by the sheet supply roller 23, and then the sheets are separated one by one between the separation roller 24 and the separation pad 25. Thereafter, a position of the leading edge of the sheet S is regulated by the registration roller 27 whose rotation is stopped, and then, the sheet S is supplied to the image forming unit 30 when the registration roller 27 rotates.

The image forming unit 30 includes an exposure unit 40, a plurality of photosensitive drums 50, a plurality of developing cartridges 60, a conveying unit 70, and a fixing unit 80.

The exposure unit 40 includes a laser diode, a deflector, lenses, and mirrors those not illustrated. The exposure unit 40 is configured to emit a plurality of laser beams for exposing surfaces of the plurality of photosensitive drums 50 and scan the surfaces.

The photosensitive drum 50 includes a photosensitive drum SOY for yellow that is an example of a first color, a photosensitive drum 50M for magenta that is an example of a second color, a photosensitive drum 50C for cyan that is an example of a third color, and a photosensitive drum 50K for black that is an example of a fourth color. Throughout the specification and drawings, in a case where colors need to be specified, members or components corresponding to the colors of yellow, magenta, cyan, and black are designated by adding "Y", "M", "C", and "K", respectively.

The developing cartridges 60 are provided corresponding to the photosensitive drums 50. Specifically, the developing cartridges 60 include a developing cartridge 60Y including a developing roller 61Y for supplying toner to the photosensitive drum 50Y, a developing cartridge 60M including a developing roller 61M for supplying toner to the photosensitive drum 50M, a developing cartridge 60C including a developing roller 61C for supplying toner to the photosensitive drum 50C, and a developing cartridge 60K including a developing roller 61K for supplying toner to the photosensitive drum 50K. Each of the developing cartridges 60 includes a casing 60A whose side surface is provided with a protrusion 63.

The developing rollers 61Y, 61M, 61C, and 61K are arrayed in this order from the upstream side to the downstream side in a conveying direction in which the sheet S is conveyed.

Each of the developing cartridges 60 is movable between a contact position where the developing roller 61 is in contact with the corresponding photosensitive drum 50 as indicated by a solid line in FIG. 1 and a separated position where the developing roller 61 is separated from the corresponding photosensitive drum 50 as indicated by an imaginary line in FIG. 1.

As illustrated in FIG. 2, the photosensitive drums 50 are rotatably supported by a support member 90. Further, the support member 90 is configured to support the developing cartridges 60Y, 60M, 60C, and 60K. The developing cartridges 60Y, 60M, 60C, and 60K are attachable to and detachable from the support member 90. The support member 90 is attachable to and detachable from the housing 10 through the front opening in a state where the front cover 11 is open.

The support member 90 includes a pair of side frames 91 (two side frames 91) and a pair of connection frames (two connections frames) (not illustrated). The two side frames 91 (the pair of side frames 91) are positioned away from each other in the axial direction of the photosensitive drum 50. The two connection frames (the pair of connection frames) connect together the front end portions of the two side frames 91, and connect together the rear end portions of the two side frames 91. In the support member 90, chargers 52 (FIG. 1) are provided corresponding to the photosensitive drums 50. Each of the chargers 52 is positioned facing the corresponding photosensitive drum 50 for charging the same.

Turning back to FIG. 1, the conveying unit 70 is positioned between the sheet tray 21 and the photosensitive drums 50. The conveying unit 70 includes a drive roller 71, a follower roller 72, a conveyer belt 73 that is an endless belt, and four transfer rollers 74. The conveyer belt 73 is looped over the drive roller 71 and the follower roller 72 under tension, and has an outer peripheral surface facing the photosensitive drums 50. Each transfer roller 74 is positioned inward of the loop of the conveyer belt 73 to nip the conveyer belt 73 in cooperation with the corresponding photosensitive drum 50. The conveying unit 70 is configured to convey the sheet S by moving the conveyer belt 73 while the sheet S is mounted on the upper outer peripheral surface of the conveyer belt 73. In the process of this conveyance of the sheet S, toner images formed on the photosensitive drums 50 are transferred onto the sheet S.

The fixing unit 80 is positioned rearward of both the photosensitive drums 50 and the conveying unit 70. The fixing unit 80 includes a heat roller 81 and a pressure roller 82 disposed facing the heat roller 81. Conveyer rollers 15 are provided above the fixing unit 80, and discharge rollers 16 are provided above the conveyer rollers 15.

In the image forming unit 30, each of the surfaces of the photosensitive drums 50 is uniformly charged by the corresponding charger 52, and then, each of the surfaces is exposed to light irradiated from the exposure unit 40. By this process, an electrostatic latent image based on image data is formed on each photosensitive drum 50.

Further, toner accommodated in the casing 60A of each developing cartridge 60 is carried on the surface of the developing roller 61, and the toner is supplied from the developing roller 61 to the electrostatic latent image formed on the surface of the corresponding photosensitive drum 50 when the developing roller 61 is brought into contact with and faces the photosensitive drum 50. By this process, toner image is formed on the surface of each photosensitive drum 50.

Then, the toner images formed on the photosensitive drums 50 are transferred onto the sheet S when the sheet S supplied on the conveyer belt 73 moves past the portions between the photosensitive drums 50 and the transfer rollers 74. Then, the toner images transferred onto the sheet S are thermally fixed to the sheet S when the sheet S moves past the portion between the heat roller 81 and the pressure roller 82.

The sheet S discharged from the fixing unit 80 is stacked onto the discharge tray 13 by the conveyer rollers 15 and the discharge rollers 16.

Next, a structure for driving and stopping the developing rollers 61, a structure for moving the developing rollers 61 so that the developing rollers 61 can be brought into contact with and separated from the photosensitive drums 50, and a structure for driving the photosensitive drums 50 will be described in detail.

Figure 2A:
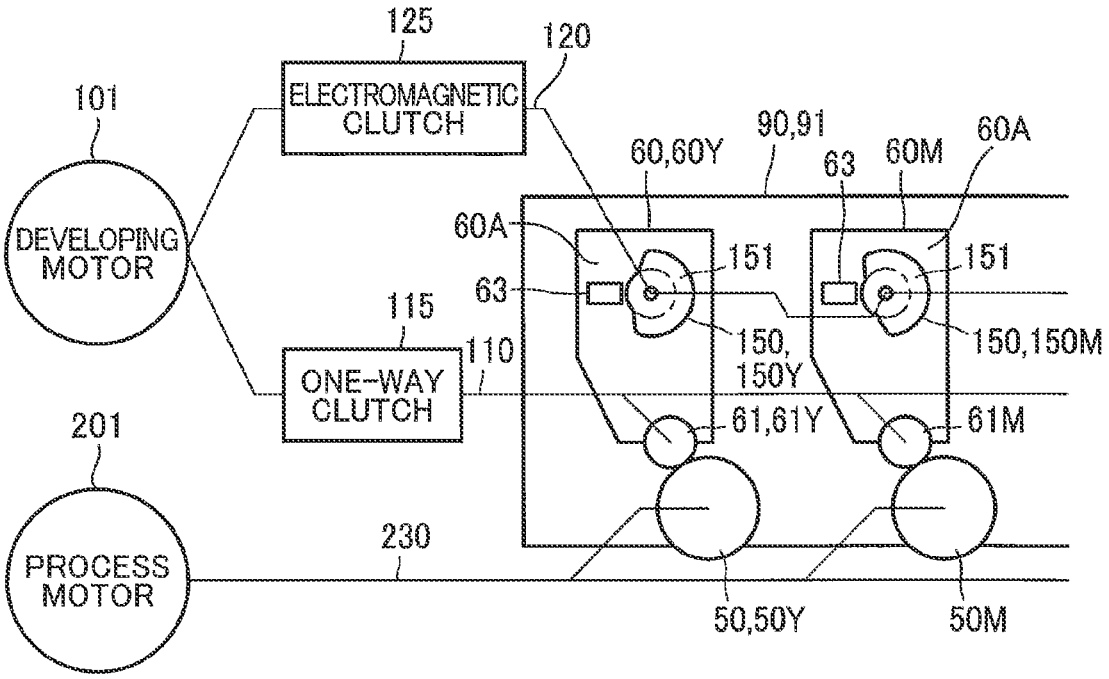
FIG. 2A is a schematic diagram for description of a cam, a first transmission mechanism, and a second transmission mechanism those for moving a developing roller in the image forming apparatus according to the embodiment, and particularly illustrating a contacting position of the developing roller in contact with a photosensitive drum.
Figure 2B:
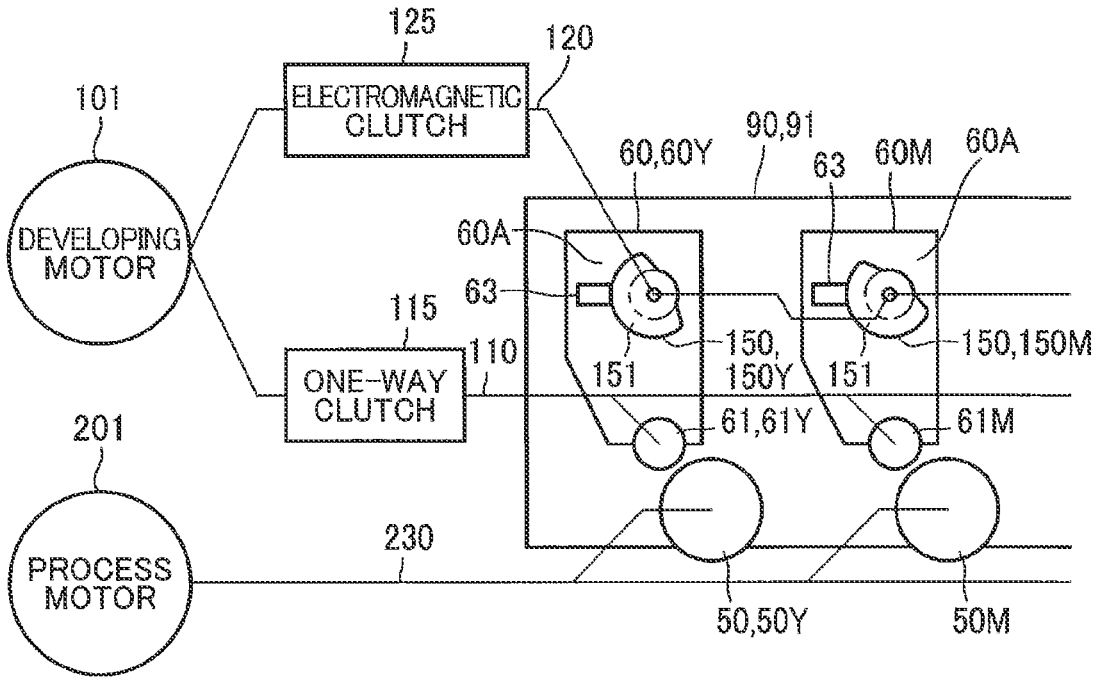
FIG. 2B is a schematic diagram for description of the cam, the first transmission mechanism, and the second transmission mechanism and particularly illustrating a separated position of the developing roller away from the photosensitive drum.

For drivingly rotating the developing rollers 61 and for moving the developing rollers 61 so that the developing rollers 61 can be brought into contact with and separated from the photosensitive drums 50, the image forming apparatus 1 includes a developing motor 101, a first transmission mechanism 110, a second transmission mechanism 120, and cams 150, as illustrated in FIGS. 2A and 2B. Further, for drivingly rotating the photosensitive drums 50, the image forming apparatus 1 includes a process motor 201 and a process transmission mechanism 230.

The developing motor 101 is a motor for driving the developing rollers 61 and the cams 150. The developing motor 101 is rotatable in not only the normal rotating direction but also the reverse rotating direction. Driving of the developing motor 101 is controlled by the controller 2. Note that, in the present embodiment, the rotating direction of the developing motor 101 when the image forming apparatus 1 performs image formation is defined as the normal rotating direction, and the opposite rotating direction to the normal rotating direction is defined as the reverse rotating direction.

The first transmission mechanism 110 includes at least one gear and a belt, and can transmit driving force of the developing motor 101 to the developing rollers 61. The first transmission mechanism 110 is configured to transmit the driving force to the developing rollers 61 in a case where the developing motor 101 rotates in the normal rotating direction, and cut off the transmission of the driving force to the developing rollers 61 in a case where the developing motor 101 rotates in the reverse direction. In other words, the first transmission mechanism 110 is configured to: engage power transmission from the developing motor 101 to the developing rollers 61 when the developing motor 101 rotates in the normal rotating direction; and disengage the power transmission from the developing motor 101 to the developing rollers 61 when the developing motor 101 rotates in the reverse rotating direction. To this effect, the first transmission mechanism 110 includes a one-way clutch 115 which transmits the driving force to the developing rollers 61 in a case where the developing motor 101 rotates in the normal rotating direction and does not transmit the driving force to the developing rollers 61 in a case where the developing motor 101 rotates in the reverse rotating direction. That is, the one-way clutch 115 is configured to: engage the power transmission from the developing motor 101 to the developing rollers 61 when the developing motor 101 rotates in the normal rotating direction; and disengage the power transmission from the developing motor 101 to the developing rollers 61 when the developing motor 101 rotates in the reverse rotating direction.

In the present embodiment, the first transmission mechanism 110 is configured to transmit the driving force from the developing motor 101 to the developing rollers 61 in parallel. In the example illustrated in FIG. 2A, the first transmission mechanism 110 includes a power transmission path from the developing motor 101 to the developing roller 61Y for the color of yellow and a power transmission path branching from the power transmission path for the developing roller 61Y and transmitting the driving force to the developing roller 61M for the color of magenta. More specifically, the first transmission mechanism 110 includes: the above-described one-way clutch 115; a first power transmission path from the developing motor 101 to the one-way clutch 115; a second power transmission path from the one-way clutch 115 to the developing roller 61Y; a third power transmission path from the one-way clutch 115 to the developing roller 61M; a fourth power transmission path from the one-way clutch 115 to the developing roller 61C; and a fifth power transmission path (not illustrated) from the one-way clutch 115 to the developing roller 61K. For example, each of the first to fifth power transmission paths is constituted by a gear train for performing power transmission from the one-way clutch 115 to the corresponding developing roller 61. However, the configuration for transmission of the driving force from the developing motor 101 to the developing rollers 61 is not limited to the example of FIG. 2A. For example, the first transmission mechanism 110 may be configured to transmit the driving force from the developing motor 101 to the developing rollers 61 in series.

The second transmission mechanism 120 includes at least one gear and a belt, and can transmit the driving force of the developing motor 101 to the cams 150 both in a case where the developing motor 101 rotates in the normal rotating direction and in a case where the developing motor 101 rotates in the reverse rotating direction. In other words, the second transmission mechanism 120 can engage power transmission from the developing motor 101 to the cams 150, irrespective of whether the developing motor 101 rotates in the normal rotating direction or in the reverse rotating direction (i.e., irrespective of the rotating direction of the developing motor 101). That is, the second transmission mechanism 120 does not includes a one-way clutch which performs transmission of the driving force in only one case of the two cases, i.e., the case where the developing motor 101 rotates in the normal rotating direction and the case where the developing motor 101 rotates in the reverse rotating direction.

In the present embodiment, the second transmission mechanism 120 is configured to transmit the driving force from the developing motor 101 to the cams 150 in series. In the example illustrated in FIG. 2A, the second transmission mechanism 120 includes a power transmission path from the developing motor 101 to the cam 150Y for the color of yellow and a power transmission path from the cam 150Y to the cam 150M for the color of magenta. More specifically, the second transmission mechanism 120 includes: an electromagnetic clutch 125 described later in detail; a sixth power transmission path from the developing motor 101 to the electromagnetic clutch 125; a seventh power transmission path from the electromagnetic clutch 125 to the cam 150Y; an eighth power transmission path from the cam 150Y to the cam 150M; a ninth power transmission path from the cam 150M to the cam 150C; and a tenth power transmission path (not illustrated) from the cam 150C to the cam 150K. For example, each of the sixth to tenth power transmission paths is constituted by a gear train for performing the assigned power transmission. However, the configuration for transmission of the driving force from the developing motor 101 to the cams 150 is not limited to the example of FIG. 2A. For example, the second transmission mechanism 120 may be configured to transmit the driving force from the developing motor 101 to the cams 150 in parallel.

The electromagnetic clutch 125 is configured to cut off transmission of the driving force from the developing motor 101 to the cams 150. In other words, the electromagnetic clutch 125 is configured to engage and disengage power transmission from the developing motor 101 to the cams 150. That is, the electromagnetic clutch 125 is controlled by the controller 2 to be switched between a transmission state where the electromagnetic clutch 125 can transmit the driving force to the cams 150 and a cut-off state where the electromagnetic clutch 125 can cut off the transmission of the driving force to the cams 150. The electromagnetic clutch 125 may be placed in the transmission state by being energized by the controller 2. Alternatively, the electromagnetic clutch 125 may be placed in the cut-off state by being energized by the controller 2. In the present embodiment, regardless of whether the electromagnetic clutch 125 is energized, the transmission state will be referred also to an ON-state and the cut-off state will be referred also to an OFF-state.

The cam 150 is a member for moving the developing roller 61 between a contacting position where the developing roller 61 is in contact with the photosensitive drum 50 and a separated position where the developing roller 61 is separated from the photosensitive drum 50. There are no particular limitations on the configuration of the cam 150 as long as the cam 150 is drivingly rotated by both the developing motor 101 and the second transmission mechanism 120.

The cam 150 is rotatably supported by the housing 10 or by the support member 90. The cam 150 has a cam lobe 151. The cam lobe 151 is provided at a part of the cam 150 in the rotating direction thereof, and is configured to press the protrusion 63 that protrudes from the side surface of the developing cartridge 60.

When the cam 150 rotates from the state illustrated in FIG. 2A, the cam lobe 151 contacts the protrusion 63 and presses the same to thereby move the developing cartridge 60 frontward as illustrated in FIG. 2B. As a result, the developing roller 61 is moved to the separated position (FIG. 2B) where the developing roller 61 is in separation from the photosensitive drum 50. When the cam 150 further rotates from the state illustrated in FIG. 2B and comes into an orientation where the cam lobe 151 does not press the protrusion 63, the developing cartridge 60 moves rearward as illustrated in FIG. 2A. As a result, the developing roller 61 is moved to the contacting position (FIG. 2A) where the developing roller 61 is in contact with the photosensitive drum 50. The developing cartridge 60 is always urged rearward by an urging member (not illustrated) such as a spring or a member made of rubber.

The process motor 201 is a motor for driving the photosensitive drums 50. Driving of the process motor 201 is controlled by the controller 2.

The process transmission mechanism 230 includes at least one gear and a belt, and can transmit driving force of the process motor 201 to the photosensitive drums 50. In the example illustrated in FIG. 2A, the process transmission mechanism 230 includes a power transmission path from the process motor 201 to the photosensitive drum 50Y for the color of yellow and a power transmission path branching from the power transmission path for the photosensitive drum 50Y and transmitting the driving force to the photosensitive drum 50M for the color of magenta. More specifically, the process transmission mechanism 230 includes: an eleventh power transmission path from the process motor 201 to the photosensitive drum 50Y; a twelfth power transmission path from the process motor 201 to the photosensitive drum 50M; a thirteenth power transmission path from the process motor 201 to the photosensitive drum 50C; and a fourteenth power transmission path (not illustrated) from the process motor 201 to the photosensitive drum 50K. For example, each of the eleventh to fourteenth power transmission paths is constituted by a gear train for performing power transmission from the process motor 201 to the corresponding photosensitive drum 50. However, the configuration for transmission of the driving force from the process motor 201 to the photosensitive drums 50 is not limited to the example of FIG. 2A. For example, the process transmission mechanism 230 may be configured to transmit the driving force from the process motor 201 to the photosensitive drums 50 in series.

Next, operations of the developing rollers 61 and the cams 150 in the above-described embodiment will be described. As illustrated in a table of FIG. 3, the developing motor 101 is controlled by the controller 2 to rotate not only in the normal rotating direction but also in the revere rotating direction, and the electromagnetic clutch 125 is controlled by the controller 2 to be switched between the ON-state and the OFF-state. As indicated in the table of FIG. 3, the cams 150 and the developing rollers 61 perform the operations determined by the combinations of the normal/reverse rotating direction (i.e., normal/reverse rotation) of the developing motor 101 and the ON/OFF state of the electromagnetic clutch 125.

Figure 4A:
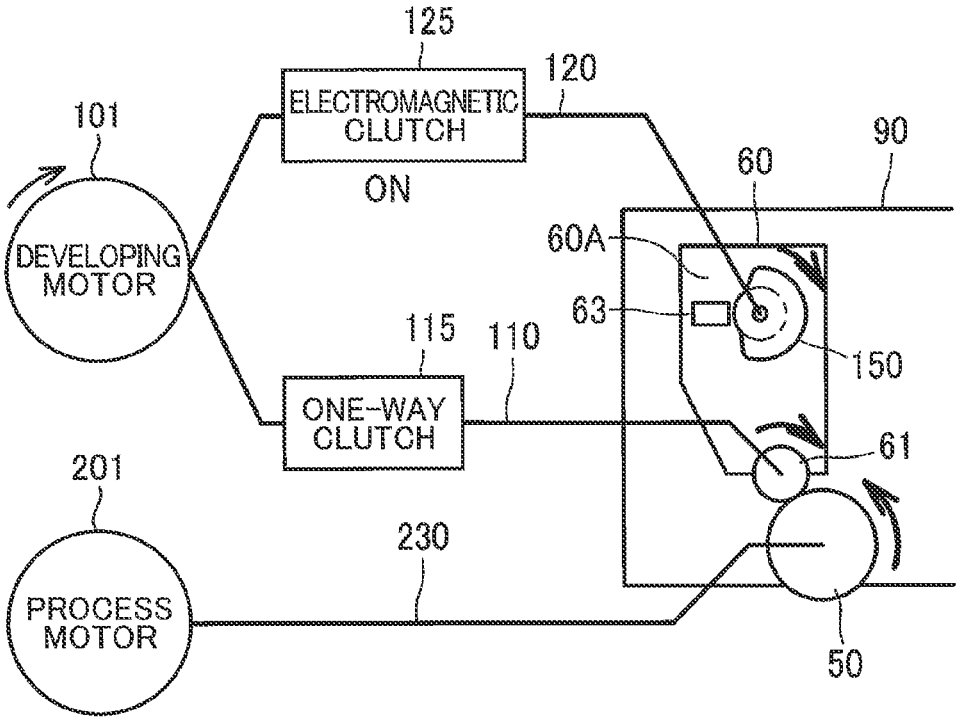
FIG. 4A is a schematic diagram for description of operations of the cam and the developing roller, and particularly illustrating a case where the developing motor rotates in a normal rotating direction in a state where the electromagnetic clutch is in an ON-state.

Specifically, as illustrated in FIG. 4A, in a case where the controller 2 controls the developing motor 101 to cause the same to rotate in the normal rotating direction, and places the electromagnetic clutch 125 into the ON-state, the driving force of the developing motor 101 is transmitted to the cam 150 through the electromagnetic clutch 125, whereby the cam 150 rotates in its normal rotating direction indicated by the arrow depicted in FIG. 4A. Further, in this case, the driving force of the developing motor 101 is also transmitted to the developing roller 61 through the one-way clutch 115, whereby the developing roller 61 rotates in its normal rotating direction indicated by the arrow depicted in FIG. 4A (also see FIG. 3). This operation can be performed, for example, for moving the developing roller 61 from the separated position to the contacting position. In this case, it is preferable to also drive the process motor 201 to rotate the photosensitive drum 50. This is because the relative peripheral speed between the outer peripheral surfaces of the photosensitive drum 50 and developing roller 61 at the moment that the developing roller 61 contacts the photosensitive drum 50 can be reduced, thereby suppressing the photosensitive drum 50 and the developing roller 61 from being damaged.

Figure 4B:
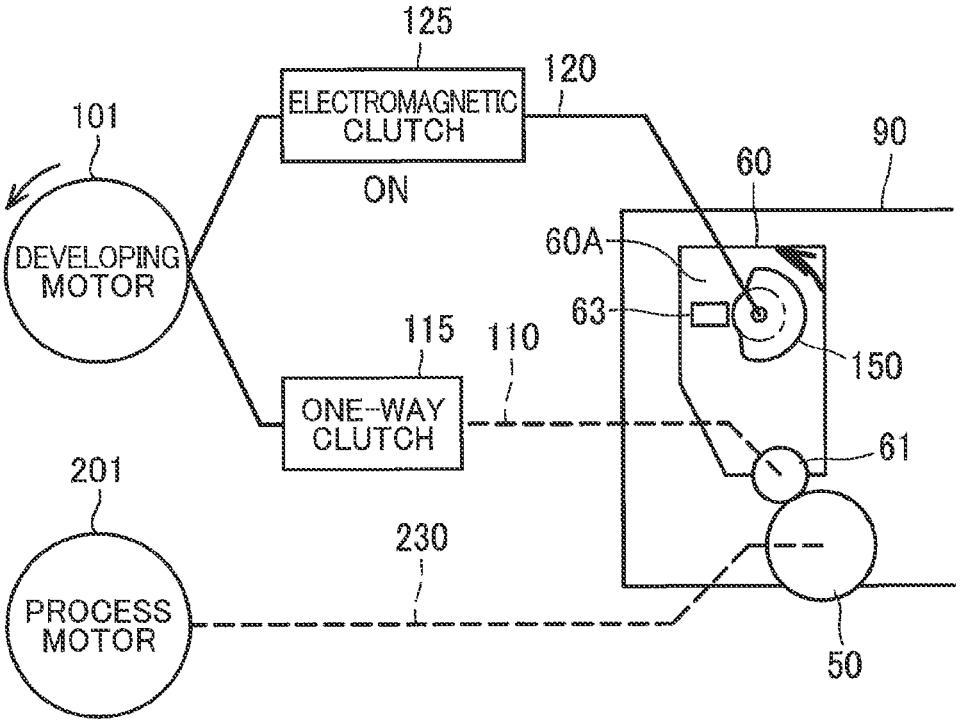
FIG. 4B is a schematic diagram for description of operations of the cam and the developing roller, and particularly illustrating a case where the developing motor rotates in a reverse rotating direction in the state where the electromagnetic clutch is in the ON-state.

As illustrated in FIG. 4B, in a case where the controller 2 controls the developing motor 101 to cause the same to rotate in the reverse rotating direction, and places the electromagnetic clutch 125 into the ON-state, the driving force of the developing motor 101 is transmitted to the cam 150 through the electromagnetic clutch 125 to rotate the cam 150 in its reverse rotating direction indicated by the arrow depicted in FIG. 4B. Further, in this case, the one-way clutch 115 cuts off the transmission of the driving force of the developing motor 101 to the developing roller 61, whereby the rotation of the developing roller 61 is stopped (also see FIG. 3). This operation can be performed, for example, for returning the developing roller 61 back to the separated position in response to the image forming apparatus 1 being turned on. In this case, since the photosensitive drum 50 is in a stopped state before the image forming apparatus 1 is turned on, it is preferable to leave the photosensitive drum 50 stopped by leaving the process motor 201 stopped. By this control, when the developing roller 61 is separated from the photosensitive drum 50, the outer peripheral surfaces of the photosensitive drum 50 and developing roller 61 are both stopped and hence, the relative peripheral speed therebetween becomes zero. Consequently, damages to the photosensitive drum 50 and developing roller 61 can be restrained.

Figure 5A:
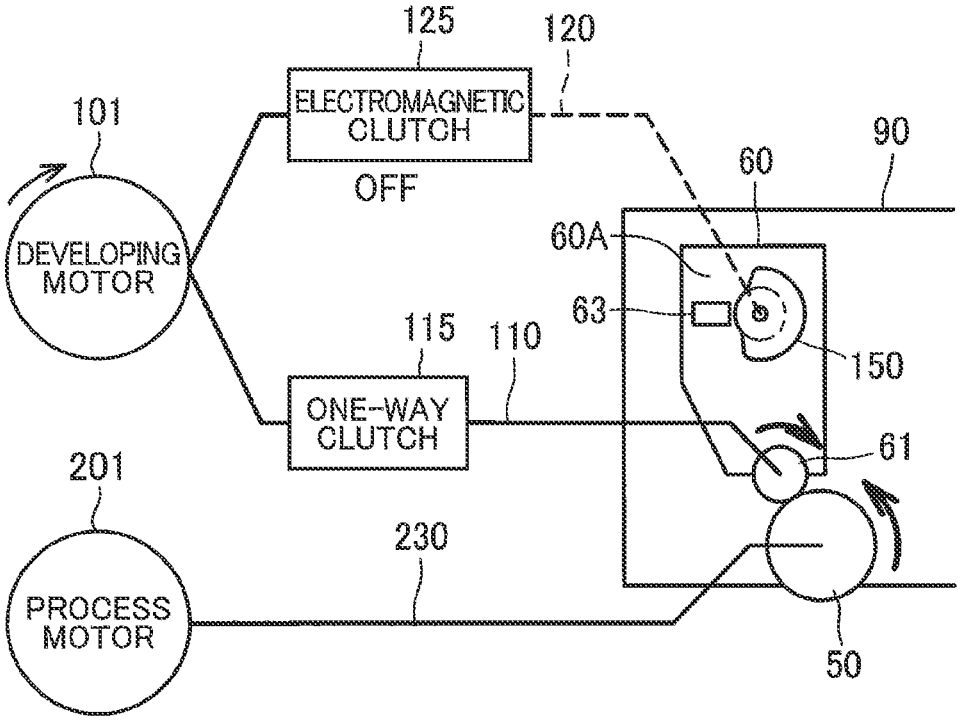
FIG. 5A is a schematic diagram for description of operations of the cam and the developing roller, and particularly illustrating a case where the developing motor rotates in the normal rotating direction in a state where the electromagnetic clutch is in an OFF-state.

As illustrated in FIG. 5A, in a case where the controller 2 controls the developing motor 101 to cause the same to rotate in the normal rotating direction, and places the electromagnetic clutch 125 into the OFF-state, the electromagnetic clutch 125 cuts off the transmission of the driving force of the developing motor 101 to the cam 150, and hence the cam 150 stops. Further, the driving force of the developing motor 101 is transmitted to the developing roller 61 through the one-way clutch 115, whereby the developing roller 61 rotates in the normal rotating direction indicated by the arrow depicted in FIG. 5A (also see FIG. 3). In this case, it is preferable to also drive the process motor 201 to rotate the photosensitive drum 50. This operation can be performed while a normal image formation is being performed, for example. This is because, in many cases, the movements of the developing roller 61 for contact with and separation from the photosensitive drum 50 is not required during the image formation.

Figure 5B:
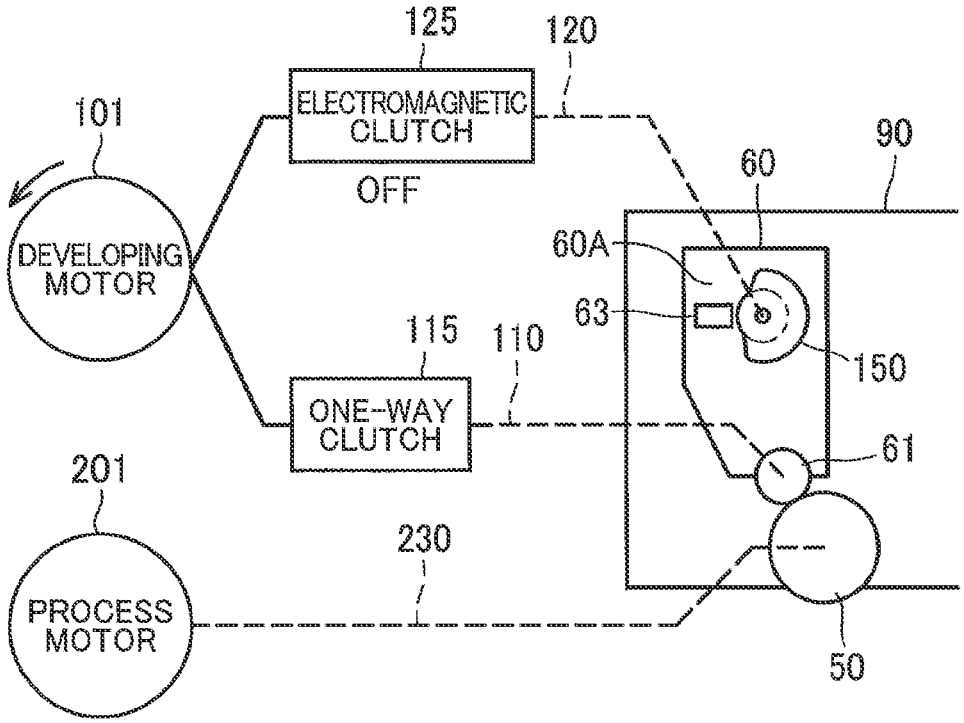
FIG. 5B is a schematic diagram for description of operations of the cam and the developing roller, and particularly illustrating a case where the developing motor rotates in the reverse rotating direction in a state where the electromagnetic clutch is in the OFF-state.

As illustrated in FIG. 5B, in a case where the controller 2 controls the developing motor 101 to cause the same to rotate in the reverse rotating direction, and places the electromagnetic clutch 125 into the OFF-state, the electromagnetic clutch 125 cuts off the transmission of the driving force of the developing motor 101 to the cam 150, and hence the cam 150 stops. Further, in this case, the one-way clutch 115 cuts off the transmission of the driving force of the developing motor 101 to the developing roller 61, and thus the developing roller 61 also stops (also see FIG. 3). That is, the cam 150 and the developing roller 61 are both stopped. In this case, it is preferable to stop the photosensitive drum 50 by stopping the process motor 201. By this, the outer peripheral surfaces of the photosensitive drum 50 and developing roller 61 are both stopped and hence, the relative peripheral speed therebetween becomes zero. As a result, damages to the photosensitive drum 50 and developing roller 61 can be restrained.

Note that, in a case where both rotations of the cam 150 and developing roller 61 are needed to be stopped, these rotations can be both stopped also by simply stopping the developing motor 101.

The operation illustrated in FIG. 5B is particularly advantageous for a case where stoppage of rotations of both the developing roller 61 and cam 150 is needed while the developing motor 101 is kept driven. For example, by switching the electromagnetic clutch 125 to the ON-state after the operation of FIG. 5B is performed, the developing roller 61 can be promptly separated from the photosensitive drum 50 without waiting for a period of time required for the developing motor 101 to accelerate.

In the image forming apparatus 1 according to the above described embodiment, the following technical advantages can be obtained.

The developing motor 101 of the image forming apparatus 1 can drive not only the developing roller 61 but also the cam 150. Hence, a motor needed for driving the developing roller 61 and a motor needed for driving the cam 150 used to move the developing roller 61 relative to the photosensitive drum 50 can be made a single common motor. As a result, the number of components can be reduced.

Further, in the image forming apparatus 1, rotation of the developing motor 101 in the normal rotating direction can cause rotations of both the developing roller 61 and cam 150, while rotation of the developing motor 101 in the reverse rotating direction can cause only rotation of the cam 150 without rotating the developing roller 61. That is, at least the following two operations can be selectively performed; one is an operation of bringing the developing roller 61 into contact with the photosensitive drum 50 and separating the developing roller 61 therefrom by rotating the cam 150 while rotating the developing roller 61, and the other is an operation of bringing the developing roller 61 into contact with the photosensitive drum 50 and separating the developing roller 61 therefrom by rotating only the cam 150 in a state where the developing roller 61 is stopped. Accordingly, by rotating the developing motor 101 in the normal rotating direction or the reverse rotating direction in accordance with the situations in the image forming apparatus 1, a desired operation can be performed in the image forming apparatus 1.

Further, since the first transmission mechanism 110 in the image forming apparatus 1 includes the one-way clutch 115, the function that when the developing motor 101 rotates in the normal rotating direction, the driving force thereof is transmitted to the developing roller 61, while when the developing motor 101 rotates in the reverse rotating direction, the driving force thereof is not transmitted to the developing roller 61, can be attained with a simple construction.

Further, since the second transmission mechanism 120 includes the electromagnetic clutch 125, the cam 150 can be switched between a driven state and a stopped state while the developing motor 101 is being driven. Therefore, a state where both the developing roller 61 and cam 150 are rotating, a state where only the developing roller 61 is rotating, and a state where only the cam 150 is rotating can be selectively performed by the combinations of: the selection of one of the normal rotation and reverse rotation of the developing motor 101; and the selection of one of the transmission state and cut-off state of the electromagnetic clutch 125.

Further, since the process motor 201 is provided separately from the developing motor 101, rotation of the photosensitive drum 50 can be independent of rotation of the developing roller 61.

While the description has been made in detail with reference to the specific embodiment, it would be apparent to those skilled in the art that many modifications and variations may be made therein.

Next, a modification of the above-described embodiment will be described while referring to FIGS. 6A through 7B. For example, as illustrated in FIGS. 6A through 7B, the image forming apparatus 1 may not be provided with the process motor 201 separately from the developing motor 101, and may include a third transmission mechanism 130 configured to transmit the driving force of the developing motor 101 to the photosensitive drums 50.

The third transmission mechanism 130 includes power transmission paths for transmitting the driving force of the developing motor 101 from the one-way clutch 115 to the photosensitive drums 50. Each of the power transmission paths of the third transmission mechanism 130 branches off from the power transmission path from the one-way clutch 115 to the developing roller 61 (e.g., branches off from the second power transmission path of the first transmission mechanism 110) and extends to the corresponding photosensitive drum 50.

More specifically, the third transmission mechanism 130 includes: a fifteenth power transmission path from the one-way clutch 115 to the photosensitive drum 50Y; a sixteenth power transmission path (not illustrated) from the one-way clutch 115 to the photosensitive drum 50M; a seventeenth power transmission path (not illustrated) from the one-way clutch 115 to the photosensitive drum 50C; and an eighteenth power transmission path (not illustrated) from the one-way clutch 115 to the photosensitive drum 50K. For example, each of the fifteenth to eighteenth power transmission paths is constituted by a gear train for performing power transmission from the one-way clutch 115 to the corresponding photosensitive drum 50.

Figure 6A:
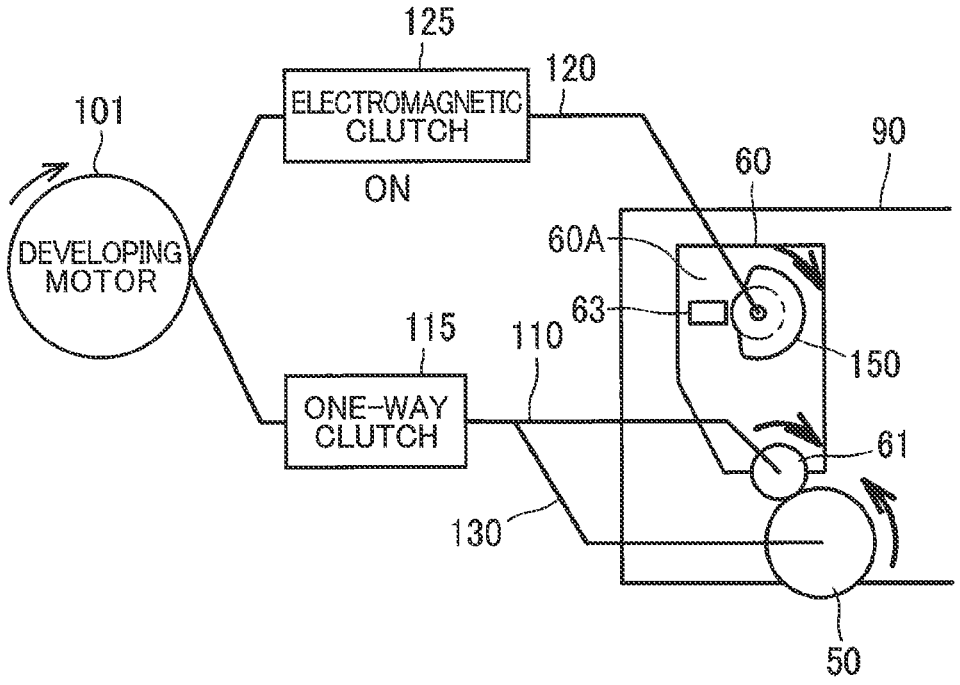
FIG. 6A is a schematic diagram for description of operations of a cam and a developing roller in an image forming apparatus according to a modification of the embodiment, and particularly illustrating a case where a developing motor of the image forming apparatus rotates in a normal rotating direction in a state where an electromagnetic clutch of the image forming apparatus is in an ON-state.

Operations in the above configuration will be described in a simplified manner. As illustrated in FIG. 6A, in a case where the controller 2 controls the developing motor 101 to cause the same to rotate in the normal rotating direction, and places the electromagnetic clutch 125 into the ON-state, the driving force of the developing motor 101 is transmitted to the cam 150 through the electromagnetic clutch 125 to rotate the cam 150 in its normal rotating direction indicated by the arrow depicted in FIG. 6A. Further, the driving force of the developing motor 101 is transmitted also to both the developing roller 61 and photosensitive drum 50 through the one-way clutch 115 to rotate both the developing roller 61 and photosensitive drum 50 in their normal direction indicated by the arrows depicted in FIG. 6A.

Figure 6B:
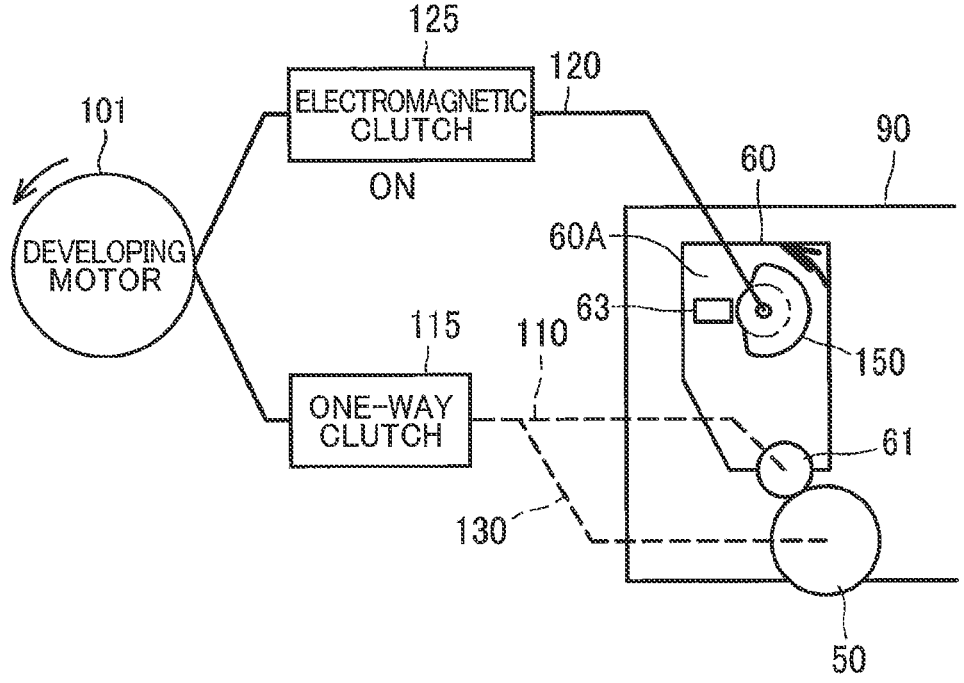
FIG. 6B is a schematic diagram for description of operations of the cam and the developing roller in the modification, and particularly illustrating a case where the developing motor rotates in a reverse rotating direction in a state where the electromagnetic clutch is in the ON-state.

As illustrated in FIG. 6B, in a case where the controller 2 controls the developing motor 101 to cause the same to rotate in the reverse rotating direction, and places the electromagnetic clutch 125 into the ON-state, the driving force of the developing motor 101 is transmitted to the cam 150 through the electromagnetic clutch 125 to rotate the cam 150 in its reverse rotating direction indicated by the arrow depicted in FIG. 6B. On the other hand, the one-way clutch 115 cuts off transmissions of the driving force of the developing motor 101 to both the developing roller 61 and photosensitive drum 50. Hence, the rotations of the developing roller 61 and photosensitive drum 50 is stopped.

Figure 7A:
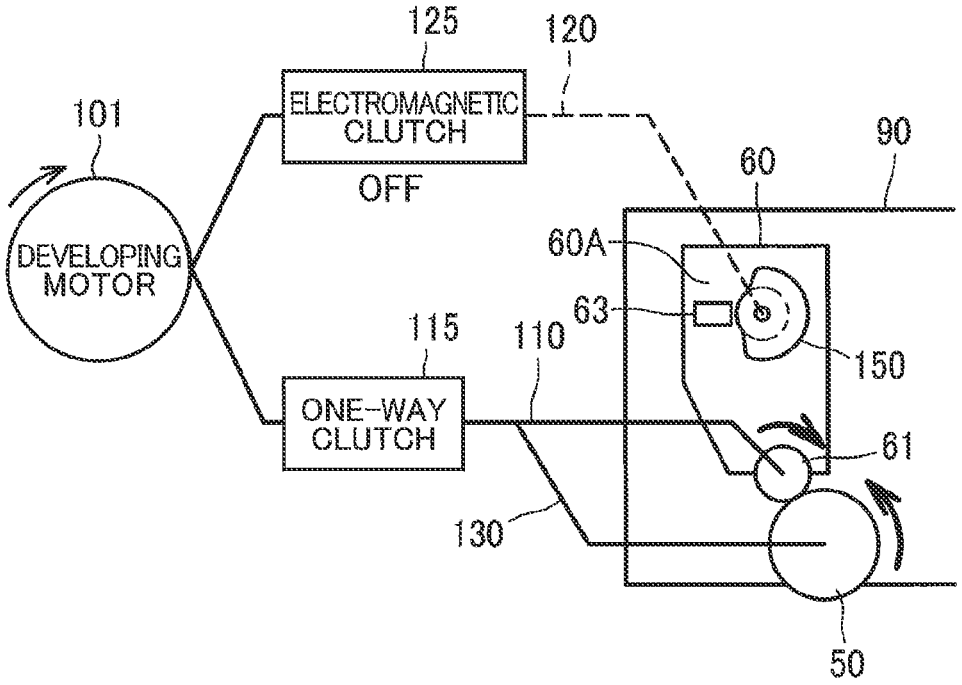
FIG. 7A is a schematic diagram for description of operations of the cam and the developing roller in the modification, and particularly illustrating a case where the developing motor rotates in the normal rotating direction in a state where the electromagnetic clutch is in an OFF-state.

As illustrated in FIG. 7A, in a case where the controller 2 controls the developing motor 101 to cause the same to rotate in the normal rotating direction, and places the electromagnetic clutch 125 into the OFF-state, the electromagnetic clutch 125 cuts off transmission of the driving force of the developing motor 101 to the cam 150, and hence the cam 150 stops. On the other hand, the driving force of the developing motor 101 is transmitted to both the developing roller 61 and photosensitive drum 50 through the one-way clutch 115. Hence, both the developing roller 61 and photosensitive drum 50 rotate in their normal rotating direction indicated by the arrow depicted in FIG. 7A.

Figure 7B:
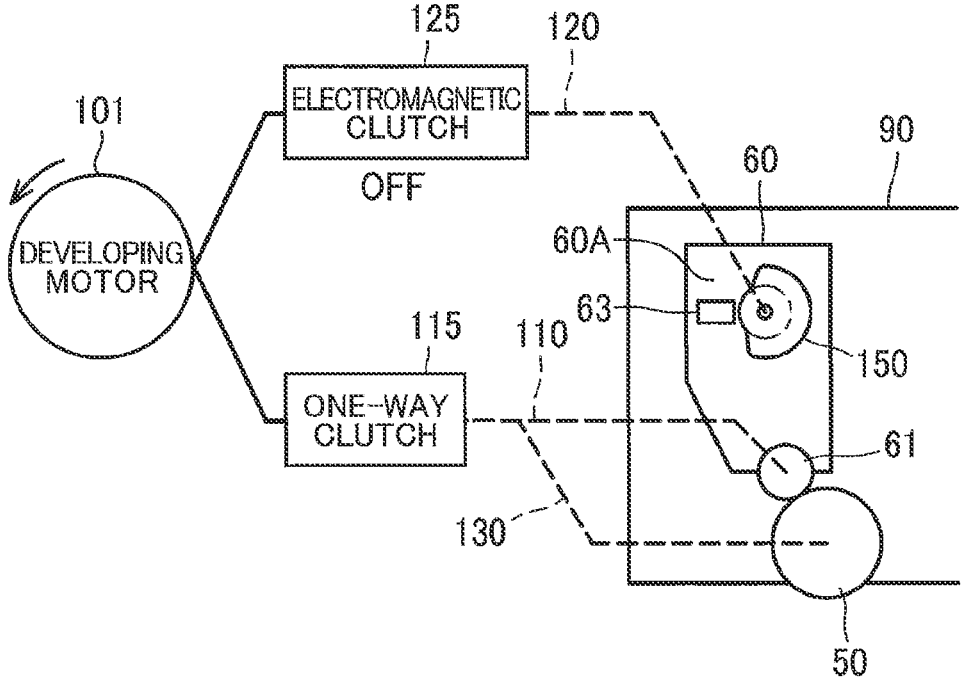
FIG. 7B is a schematic diagram for description of operations of the cam and the developing roller in the modification, and particularly illustrating a case where the developing motor rotates in the reverse rotating direction in a state where the electromagnetic clutch is in an OFF-state.

As illustrated in FIG. 7B, in a case where the controller 2 controls the developing motor 101 to the same to rotate in the reverse rotating direction, and places the electromagnetic clutch 125 into the OFF-state, the electromagnetic clutch 125 cuts off transmission of the driving force of the developing motor 101 to the cam 150, and hence the cam 150 stops. Further, the one-way clutch 115 cuts off transmissions of the driving force of the developing motor 101 to both the developing roller 61 and photosensitive drum 50. Hence, both the developing roller 61 and photosensitive drum 50 are stopped.

A combination of the first transmission mechanism 110 and the third transmission mechanism 130 in the present modification is an example of the claimed "first transmission mechanism". The first power transmission path and the gear train constituting the same in the first transmission mechanism 110 of the present modification are examples of the claimed "first power transmission path" and "first gear train". The second power transmission path and the gear train constituting the same in the first transmission mechanism 110 of the present modification are examples of the claimed "second power transmission path" and "second gear train". The fifteenth power transmission path and the gear train constituting the same in the third transmission mechanism 130 of the present modification are examples of the claimed "third power transmission path" and "third gear train".

According to the above modification illustrated in FIGS. 6A through 7B, in all the operating states, the start timing of rotation of the developing roller 61 is coincident with that of the photosensitive drum 50 and the stop timing of rotation of the developing roller 61 is coincident with that of the photosensitive drum 50. Therefore, adjustment of timed relation between the operation of the developing roller 61 and the operation of the photosensitive drum 50 for making the timings of these operations coincident does not need to be performed by the controller 2, thereby facilitating control.

In other words, the start and stop of rotation of the developing roller 61 can be mechanically interlocked with the start and stop of rotation of the photosensitive drum 50. Further, the number of motors can be reduced, thereby achieving downsizing and energy saving of the image forming apparatus 1.

Further, the configuration of the cam 150 is not limited to the above-described configuration. For example, an end cam, a cylindrical cam, or a bell cam which have a cam surface at an end face of a hollow cylindrical member and a drum cam having a cam groove at an outer peripheral surface of a hollow cylindrical member are available.

Further, according to the above-described embodiment, the image forming apparatus 1 is a color printer that prints color images using toners of four colors. However, the image forming apparatus 1 may be an image forming apparatus that prints monochromatic images or an image forming apparatus that prints color images using toners of three colors or five colors.

Further, a multifunction device and a copying machine are also available as the image forming apparatus.

What is claimed is:

1. An image forming apparatus comprising:
a photosensitive drum;
a developing roller;
a cam for moving the developing roller between a contacting position where the developing roller is in contact with the photosensitive drum and a separated position where the developing roller is separated from the photosensitive drum;
a developing motor for driving both the developing roller and the cam, the developing motor being rotatable in a normal rotating direction and a reverse rotating direction; and
a first transmission mechanism configured to:
engage power transmission from the developing motor to the developing roller when the developing motor rotates in the normal rotating direction; and
disengage the power transmission from the developing motor to the developing roller when the developing motor rotates in the reverse rotating direction.

2. The image forming apparatus according to claim 1, wherein the first transmission mechanism comprises a one-way clutch configured to:
engage the power transmission from the developing motor to the developing roller when the developing motor rotates in the normal rotating direction; and
disengage the power transmission from the developing motor to the developing roller when the developing motor rotates in the reverse rotating direction.

3. The image forming apparatus according to claim 2, wherein the first transmission mechanism comprises:
a first power transmission path from the developing motor to the one-way clutch;
a second power transmission path from the one-way clutch to the developing roller; and
a third power transmission path from the one-way clutch to the photosensitive drum.

4. The image forming apparatus according to claim 3, wherein the first transmission mechanism is further configured to:
engage power transmission from the developing motor to the photosensitive drum when the developing motor rotates in the normal rotating direction; and
disengage power transmission from the developing motor to the photosensitive drum when the developing motor rotates in the reverse rotating direction.

5. The image forming apparatus according to claim 2, wherein the first transmission mechanism is configured to:
transmit power from the developing motor to the one-way clutch;
transmit power from the one-way clutch to the developing roller; and
transmit power from the one-way clutch to the photosensitive drum.

6. The image forming apparatus according to claim 1, further comprising a process motor for driving the photosensitive drum.

7. The image forming apparatus according to claim 1, further comprising:
a support member; and
a developing cartridge attachable to and detachable from the support member, the developing cartridge comprising:
the developing roller;
a casing rotatably supporting the developing roller; and
a protrusion protruding from the casing,
wherein contact of the cam with the protrusion causes the developing roller to move from the contacting position to the separated position.

8. An image forming apparatus comprising:
a photosensitive drum;
a developing roller;
a cam for moving the developing roller between a contacting position where the developing roller is in contact with the photosensitive drum and a separated position where the developing roller is separated from the photosensitive drum;
a developing motor for driving both the developing roller and the cam, the developing motor being rotatable in a normal rotating direction and a reverse rotating direction; and
a one-way clutch configured to:
engage power transmission from the developing motor to the developing roller when the developing motor rotates in the normal rotating direction; and
disengage the power transmission from the developing motor to the developing roller when the developing motor rotates in the reverse rotating direction.

9. The image forming apparatus according to claim 8, further comprising a process motor for driving the photosensitive drum.

10. The image forming apparatus according to claim 8, further comprising:

a support member; and a developing cartridge attachable to and detachable from the support member, the developing cartridge comprising:

the developing roller;

a casing rotatably supporting the developing roller; and a protrusion protruding from the casing, wherein the cam contacts the protrusion to move the developing roller from the contacting position to the separated position.

11. An image forming apparatus comprising:

a photosensitive drum;

a developing roller;

a cam for moving the developing roller between a contacting position where the developing roller is in contact with the photosensitive drum and a separated position where the developing roller is separated from the photosensitive drum;

a developing motor for driving both the developing roller and the cam;

a one-way clutch for engaging power transmission from the developing motor to the developing roller; and an electromagnetic clutch for engaging and disengage power transmission from the developing motor to the cam.

12. The image forming apparatus according to claim 11, further comprising a process motor for driving the photosensitive drum.

13. An image forming apparatus comprising:

a photosensitive drum;

a developing roller;

a cam for moving the developing roller between a contacting position where the developing roller is in contact with the photosensitive drum and a separated position where the developing roller is separated from the photosensitive drum;

a motor for driving both the developing roller and the cam, the motor being rotatable in a normal rotating direction and a reverse rotating direction;

a first clutch disposed on a first power transmission path for transmitting a driving force from the motor to the developing roller; and a second clutch disposed on a second power transmission path for transmitting a driving force from the motor to the cam.

14. The image forming apparatus according to claim 13, further comprising a process motor for driving the photosensitive drum.

15. The image forming apparatus according to claim 13, wherein the first clutch is a one-way clutch.

16. The image forming apparatus according to claim 13, wherein the second clutch is an electromagnetic clutch.

17. An image forming apparatus comprising:

a developing roller for developing toner image on a photosensitive drum;

a cam for moving the developing roller;

a motor for driving both the developing roller and the cam;

a first power transmission path for transmitting a driving force from the motor to the developing roller, the first power transmission path including a first clutch; and a second power transmission path for transmitting a driving force from the motor to the cam, the second power transmission path including a second clutch.

18. The image forming apparatus according to claim 17, wherein the first clutch is a one-way clutch; and wherein the second clutch is an electromagnetic clutch.

* * * * *